US005833193A

United States Patent [19]

Derda et al.

[11] Patent Number: 5,833,193

[45] Date of Patent: Nov. 10, 1998

[54] EXPANDABLE AND ADJUSTABLE DISPLAY DEVICE

[76] Inventors: Roger Derda, 28624 Canyon Oak Dr., Highland, Calif. 92346; David T. Adrian, 42925 Hillrise Rd., Banning, Calif. 92220

[21] Appl. No.: 742,457

[22] Filed: Nov. 1, 1996

[51] Int. Cl.[6] ..... A47F 5/00

[52] U.S. Cl. ..... 248/298.1; 248/205.2

[58] Field of Search ..... 248/298.1, 205.2, 248/346.06, 466, 309.1; 160/368.1, 330, 38; 40/491, 488, 594, 618, 620

[56] References Cited

U.S. PATENT DOCUMENTS

| | | | |
|---|---|---|---|
| 4,890,571 | 1/1990 | Gaskill | 248/205.2 |
| 5,060,712 | 10/1991 | Ehrlich | 160/330 |
| 5,597,025 | 1/1997 | Forkner | 160/368.1 |
| 5,673,741 | 10/1997 | Cairns | 160/368.1 |

*Primary Examiner*—Ramon O. Ramirez
*Assistant Examiner*—Willie Berry, Jr.

[57] ABSTRACT

An expandable and adjustable display device for textiles comprising a rigid flattened main body of unspecified length having overlapping channels in which rigid removable slidable bar arm members of equal length fit into the channels and extend longitudinally from the main body allowing expansion and adjustment of the position of the arm members. Said slidable arm members possessing a rigid flattened holding pad at its fore end proportionate in thickness to the main body. The slidable bar arm members possessing the means on the aft end to accept an unspecified number of pad spacers substantially proportionate in size as the pad provided on the fore end of the slidable arm member. The face of the main body, the pads, and spacers having attached a holding strap containing hook fasteners substantially proportionate in width and length as the main body, pads, and spacers for penetrating and supporting the textiles. The textile fibers possessing the means to attach directly to the hook fasteners, or, the textiles having attached to them, a loop system of roughly identical width as the hook fastener for purpose of mounting the loop system to the fastener. The main body of the invention possessing means for mounting the device on a wall surface. The expandable and adjustable display device possessing the singular means to accommodate textiles of various proportions.

10 Claims, 4 Drawing Sheets

14
10
16
14
12B
12T

20LB
18L
22LHP
16
FIG. 2-A
22RHP
16
18R
20RB
FIG. 2-B
16
24
12B
12T
FIG. 2-C

EXPANDABLE AND ADJUSTABLE DISPLAY DEVICE

BACKGROUND

1. Field of Invention

This invention relates to display devices for textiles, specifically an improved display device which expands and adjusts to accommodate a variety of different sized textiles and, when combined with a textile, is imperceptible to the human eye.

2. Description of Prior Art

Textiles when displayed, need enough support to prevent stress-related damage. For many years, individuals seeking to mount textiles on a wall have had to improvise and rely on thumb-tacks, staples, nails, tack strips, rings, and other makeshift devices for such purposes. The need for a more innovative and versatile hanging device is obvious when such devices are examined more thoughtfully.

For the exception of tack strips made to accommodate the exact proportions of the textile to be mounted, the majority of these makeshift devices are visible to the human eye. In addition to being unsightly and distracting, such devices provide a non-uniform support that can cause distortion, as well as tears and staining from metal corrosion that can damage fibers. In instances where tack strips are utilized which have been made proportionate in size to the textile which will be mounted to it, while not visible, they create similar problems to the makeshift devices previously described, in that they can damage a textile by snagging, tearing, or pulling the fibers.

There exists in the marketplace commercial clamping devices used to display textiles, however, such devices: (1) are visible and obtrusive to the human eye, (2) conceal the border of the textile covering design features and negatively impacting the overall enjoyment and visual impact of the piece, (3) crimp textile fibers leaving indentations and creating fiber damage, and (4) are of fixed length having no means to expand and adjust to a variety of different sized textiles.

Hook and loop fastening devices attached to a wall or rigid member of fixed length have also been used to support textiles. Such devices eliminate possible damage to textiles and are imperceptible to the human eye when coupled, however, they possess limitations and inconveniences similar to devices previously described in that, they do not contain means for expansion and adjustment which would accommodate a variety of textile sizes for those individuals who want to replace and/or interchange their textiles without the major inconvenience of having to make or find a hanging device which will accommodate the particular size of textile to be displayed.

In all instances, the aforementioned methods of mounting are either improper, thereby creating damage to the textile, or, possess limitations for which this invention provides substantial improvement over the limitations of such prior art, details of which are described hereinafter.

OBJECTS AND ADVANTAGES

Accordingly, besides the objects and advantages of the expandable and adjustable display device described in our above patent, several objects and advantages of the present invention are:

(a) to provide a display device which is fast and simple to install;

(b) to provide a display device which allows textiles to be quickly and safely detached from its display position which is especially useful in emergencies;

(c) to provide a display device which is versatile and possesses the means to expand and adjust to a variety of different sized textiles thereby accommodating quick and easy replacement and/or interchange of textiles;

(d) to provide a display device which is not perceptible when joined/combined with a textile;

(e) to provide a display device which will not conceal a textile's border or cover design elements;

(f) to provide a display device which provides uniform support of textiles reducing the potential for distortion;

(g) to provide a display device which will not crimp, snag, tear, pull, stain, leave indentations or cause other fiber related damage.

Further objects and advantages of our invention will become apparent from a consideration of the drawings and ensuing description.

DRAWING FIGURES

In the drawings , closely related figures have the same number but different alphabetic suffixes.

Figure 2:
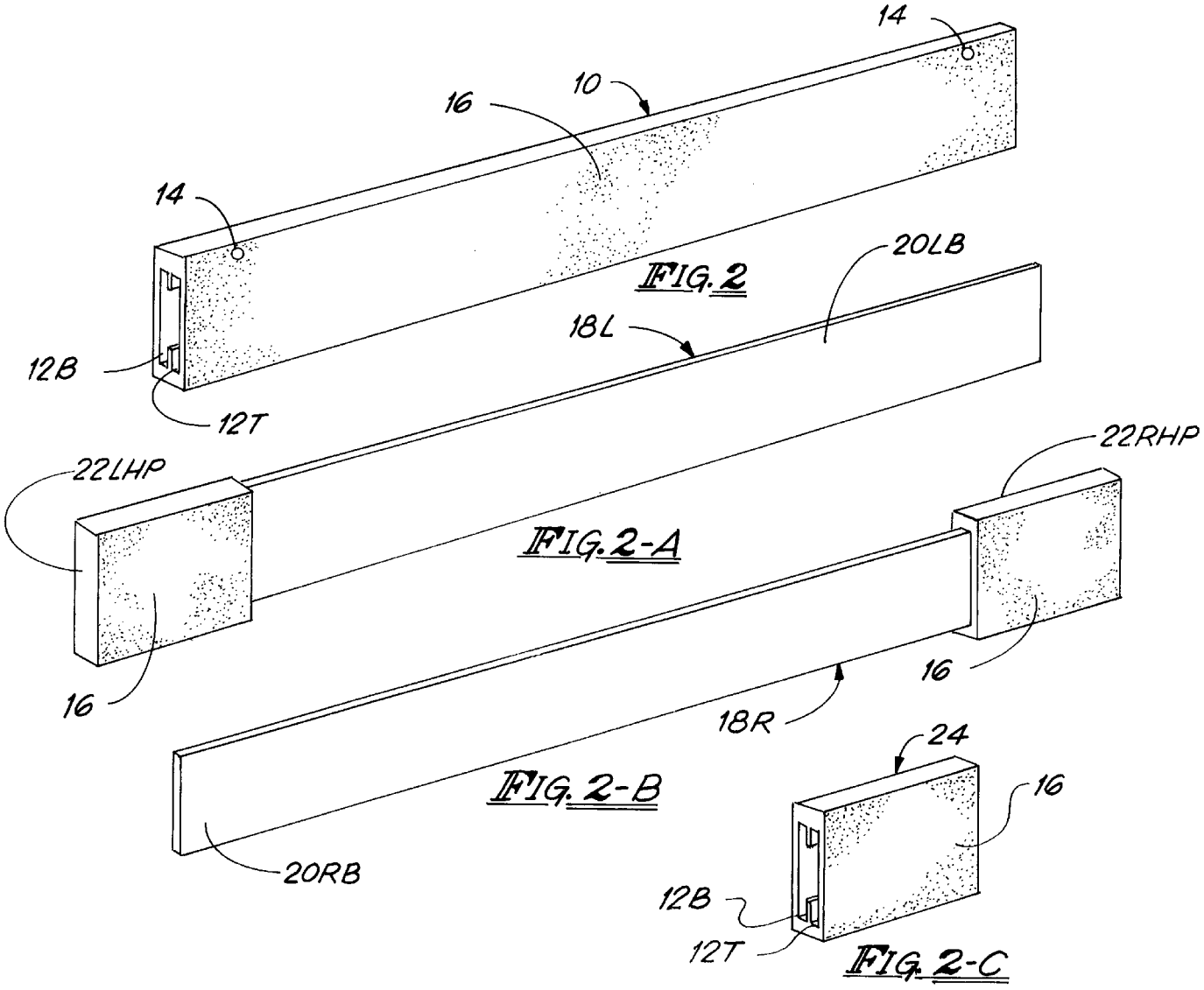
FIG. 2 shows a perspective view of a main body.

FIG. 2-A shows a perspective view of a slidable left arm member.

FIG. 2-B shows a perspective view of a slidable right arm member.

FIG. 2-C shows a perspective view of a slidable support spacer

Figure 3:
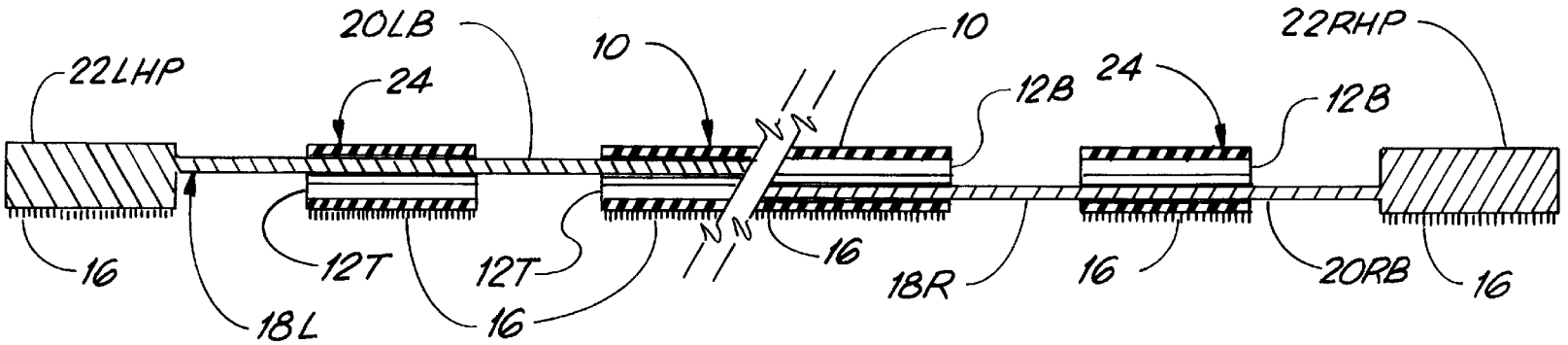

FIG. 3 shows an inverted vertical cross section detail of a expandable and adjustable display device with location of overlapping channels in the main body and slidable support spacers, placement of a left and right slidable arm members inserted into the main body of the device, and slidable support spacers positioned on the bar elements of the respective left and right slidable arm members.

Figure 4:
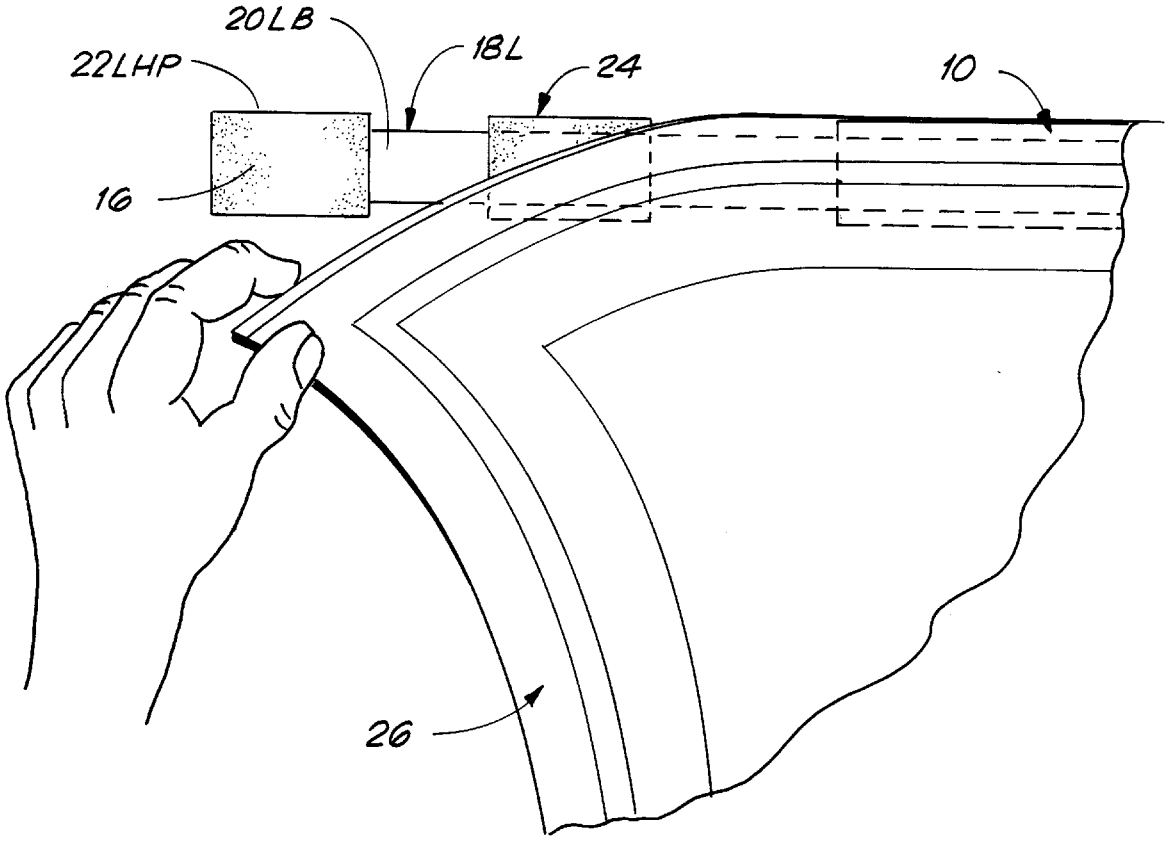

FIG. 4 shows an elevational view of an expandable and adjustable display device having a textile attached to a main body, left arm holding pad, and a slidable support spacer element.

REFERENCE NUMERALS IN DRAWINGS

10 Main body
12 B Bottom Channel
16 Holding Strap Containing Hook Fasteners
18 R Slidable Right Arm Member
20 RB Right Arm Bar
22 RHP Right Arm Holding Pad
26 Textile
12 T Top Channel
14 Opening for Mounting
18 L Slidable Left Arm Member
20 LB Left Arm Bar
22 LHP Left Arm Holding Pad
24 Slidable Support Spacer

DESCRIPTION—FIGS. 1 to 4

Figure 1:
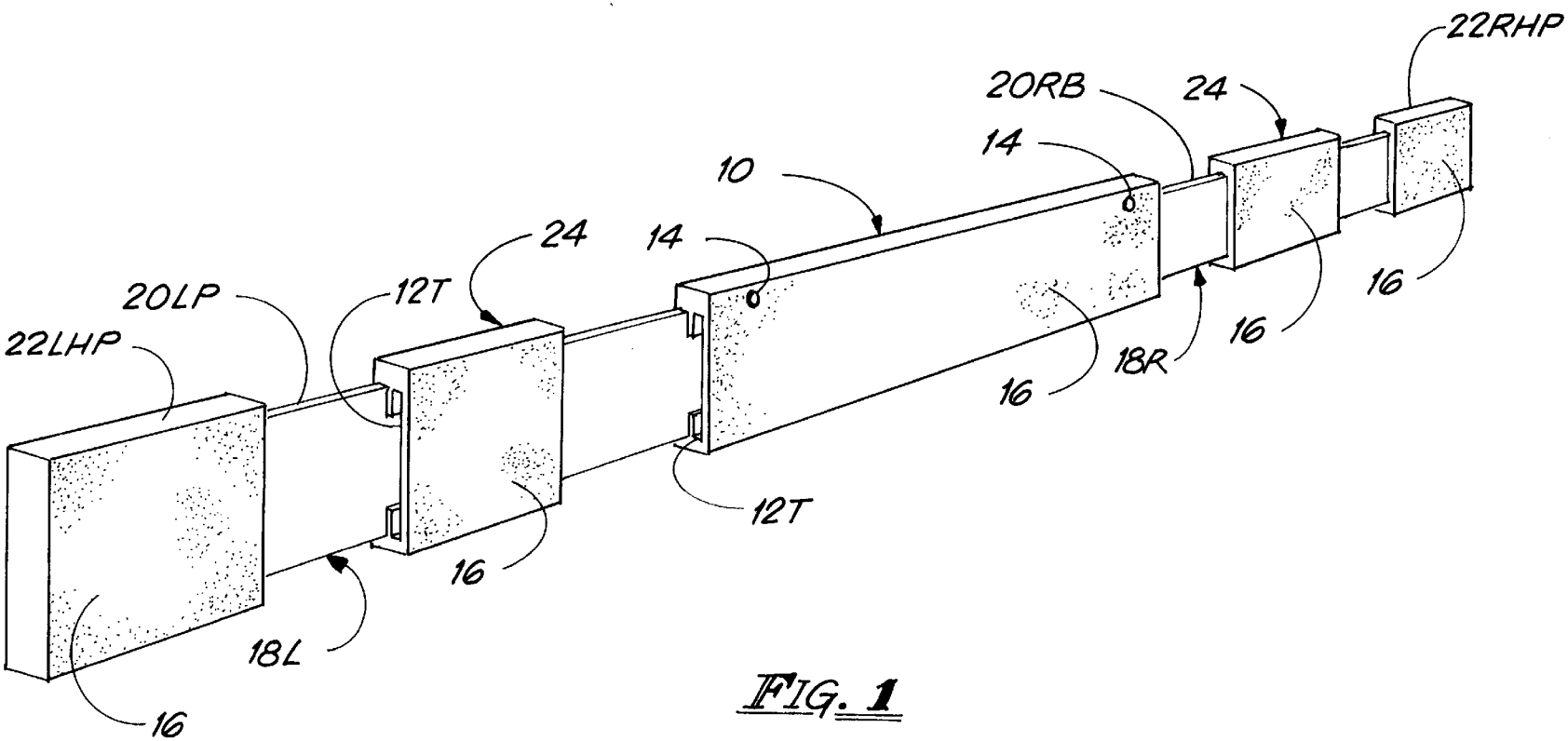
FIG. 1 shows a perspective view of a expandable and adjustable display device comprising a main body, removable left and right slidable arm members, removable slidable support spacers, and holding strap containing hook fasteners.

Referring to FIG. 1, it will be seen that the expandable and adjustable display device of the present invention comprises a rigid main body of elongated rectangular form of unspecified length 10, having two openings for mounting 14, two flattened slidable arm members 18L and 18R having integrally formed thereon flattened holding pads 22LHP and 22RHP, and slidable support spacers 24, the face of said main body 10, flattened holding pads 22LHP and 22RHP, and slidable support spacers 24, all having attached a holding strap containing hook fasteners 16 of proportionate size as said components, the hook fasteners serving as the coupling means to accept and hold textiles when textiles are attached to the same. More specifically, FIG. 2, of the present invention shows a body 10 having integrally formed therein, a top channel 12T which is positioned atop a bottom channel 12B, said overlapping channels 12T and 12B being of unspecified thickness and extending the full length of said body 10. The channel 12T serving as the means to accept a left arm bar 20LB of slidable left arm member 18L, and said channel 12B serving as the means to accept a right arm bar 20RB of slidable right arm member 18R, said slidable arm members serve as the means to expand the hanging device to the dimension of the textile which is to be attached to said device. The top face of the body 10 having joined to it the holding strap of approximately the same length and width containing hook fasteners 16 which serve as the coupling means to accept and hold textiles. The top face of the body 10 having openings 14 for mounting the display device to a wall with screws, nails, or other suitable anchoring device. In the illustration of FIG. 2-A, it also will be seen a flattened slidable arm member 18L comprising a flattened arm bar 20LB with a flattened rectangular arm holding pad 22LHP being integrally formed onto the fore end of said arm bar 20LB. The left arm bar 20LB of said slidable arm member 18L inserts into the bottom channel 12B of the main body 10, and the left arm bar 20LB of elongated slidable arm member 18L inserts into the top channel 12T of the main body 10. In the illustration of FIG. 2-B, it also will be seen a flattened slidable arm member 18R comprising a flattened arm bar 20RB with a flattened rectangular arm holding pad 22RHP being integrally formed onto the fore end of said arm bar 20RB. The right arm bar 20RB of said slidable arm member 18R inserts into the bottom channel 12B of the main body 10, and the right arm bar 2ORB of elongated slidable arm member 18R inserts into the bottom channel 12B of the main body 10. The channel 12T serving as the means to accept a left arm bar 20LB of slidable left arm member 18L, and said channel 12B serving as the means to accept a right arm bar 20RB of slidable right arm member 18R, said slidable arm members serve as the means to expand the hanging device to the dimension of the textile which is to be attached to said device. Additionally, the construction of the slidable arm members 18L and 18R is such that when the arm members are inserted into said respective channels 12T and 12B contained within the main body 10, the face and back of the arm member holding pads 22LHP and 22RHP are evenly aligned with the face and back of the main body, being the same thickness and width as the rigid materials comprising the main body 10. It is possible to interchange the slidable arm members 18L and 18R in a manner whereby the right arm member 18R inserts into the channel contained in the main body designated for the left arm member 18L and vice versa, providing that when inserted, the arm members are positioned into the channel of the main body which results in the face and back of the arm members being evenly aligned with the face and back of the main body 10. The face of said arm pads 22LHP and 22RHP have joined to it a holding strap containing hook fasteners 16 which serve as the coupling means to accept and hold textiles. When grasped with forefinger and thumb and pulled away from the main body 10, the slidable arm members 18R and 18L provide the means to expand and adjust the device and accommodate textiles that are wider than the fixed length of the main body 10.

In the illustration of FIG. 2-C it also will be seen a perspective view of a slidable support spacer element 24 being of identical thickness as the main body 10 and the holding pads 22RHP and 22LHP, and having integrally formed therein a top channel 12T which is positioned atop a bottom channel 12B, said overlapping channels 12T and 12B being of unspecified thickness and extending the full length of said slidable support spacer 24. The overlapping channels 12T and 12B are of identical proportions as the overlapping channels contained within main body 10. The top face of the slidable support spacer 24 having joined to it a holding strap of approximately the same length and width containing hook fasteners 16 which serve as the coupling means to accept and hold textiles. The channel elements 12T and 12B contained within slidable support spacer 24 provide the means to slide onto arm bars 20LB and 20RB thereby supplying additional support of textiles when the slidable arm members 18L and 18R are slid away from the main body 10. Preferably, the body 10, slidable support spacers 24, flattened arm bars 22LB and 22RB, and arm pads 22LHP and 22RHP, may be made from extruded plastic materials, however, any other suitable shape or type of material may be used, as desired. FIG. 3 shows an inverted vertical cross section detail of an assembled expandable and adjustable display device depicting a main body 10 having a top channel 12T and a bottom channel 12B with placement of a left slidable arm member 18L and a right slidable arm member 18R inserted into said overlapping channels 12T and 12B of said main body 10, a slidable support spacer element 24 inserted into a main body. FIG. 4 shows an elevational view of the present invention on which a textile 26 has been attached to a holding strap containing hook fasteners 16 located and joined to the face of a main body 10. A left slidable arm member 18L is shown with a slidable support spacer element 24 placed onto a left arm bar 20LB prior to said left arm bar 20LB having been inserted into a cavity of said main body 10. The slidable arm member 18L having been slid from the cavity of the main body 10 to a position whereby the slidable arm member 18L extends to and aligns with the width of said textile 26 which is being attached to a exposed left arm pad 22LHP and a sliding and slidable support spacer element 24 comprising said slidable arm member 18L. Said components having hook fasteners 16 joined to the face of said slidable support spacer element 24 and said left arm pad 22LHP so that they can accept the nappy fibers of the textile 26 which is being joined to the same. The slidable support spacer element 24 being positioned between the main body 10 and the left arm pad 22LHP for purposes of providing additional and even support for the textile 26 being attached to the same.

OPERATION—FIG. 4

While FIG. 4 of the drawings depicts only the left portion of the display device, the right portion works identically to the left portion and for purposes of describing its operation references will be made to components comprising the entire device.

The manner of using the expandable and adjustable display device in hanging a textile is as follows: One firsts mounts the main body 10 of the device to a wall by use of screws or nails by inserting them into the mounting openings 14 located on the face of the main body. Depending upon the width of the textile 26 to be displayed several options exist. If the width of the textile to be hung is of identical length as the main body, the textile need only be secured to the hook fasteners 16 mounted upon and extending the entire length of the main body. If however the textile is wider, than either one or both of the slidable arm members 18L and 18R, and slidable support spacer(s) 24 are utilized. In order to ensure even support of the textile and prevent drooping, support spacer(s) are first slid onto either or both arm bars 18L and 18R comprising the slidable arm members. The slidable left arm member 18L is then inserted into the top channel 12T of the main body and slidable right arm member 18R is then inserted into the bottom channel 12B. Both arm members are then inserted into the main body. Utilizing the forefinger and thumb, the holding pads 22LHP and 22RHP are grasped and then each arm member is slid away from the main body and adjusted to the width of the textile which is to be attached to the main body, holding pads and spacer(s). The support spacer(s) can be slid and positioned anywhere along the arm bars and serve as the means to provide additional support and prevent drooping. The textile is positioned where its border aligns with the display device, then utilizing one's hands, the textile is pressed against and attached to the hook fasteners which are attached to and comprise the face of the main body, support spacer(s) and holding pads.

SUMMARY, RAMIFICATIONS, AND SCOPE

Accordingly, the reader will see that the expandable and adjustable display device of this invention can be utilized to exhibit and interchange a variety of different sized textiles easily and conveniently. In addition, the invention provides an opportunity for people to enjoy the full beauty of their textile(s). Furthermore, this adjustable display device has the additional advantages in that

- it is imperceptible to the human eye when coupled with a textile, eliminating conspicuous and obtrusive mounts and/or mounting devices;
- it does not obscure design elements or portions of the textile like other mounts and mounting devices
- it will not damage textile fibers like other mounts and mounting devices;
- it provides uniform support of textiles superior to other mounts and mounting devices.

While the invention has been described and illustrated in its several preferred embodiments, it should be understood that the invention is not to be limited to the precise details herein illustrated and described since the same may be carried out in other ways falling within the scope of the invention as illustrated and described. For example, the main body could be made to accommodate a single or multiplicity of slidable arm members; the position of the cavities within the main body could be re-arranged to accept the slidable arm members in a different fashion (vertically overlapping rather than horizontally overlapping), etc.

Thus, the scope of the invention should be determined by the appended claims and their legal equivalents, rather than by the examples given.

We claim:

1. In a display device of the type comprising a rigid flattened main body containing a plurality of holes near its upper end for purposes of mounting the body to a wall, the improvements wherein said main body has a plurality of channels which serve as the slidable means for a plurality of arm member supports which insert fully or partially into said channels and adjust and expand longitudinally to a multiplicity of various sized nappy textured textiles, and said arm member supports provide the attachment means for a plurality of support spacer elements of proportions designed to slide onto the arm member supports and positioned such as to prevent sagging of textiles attached thereon, and the main body, said arm member supports, and support spacer elements having fused onto its top side a holding strap comprising the hook side of loop and hook fasteners which serves as the holding means to display textiles and which, when coupled with a textile, results in the device being completely concealed and not visible to the human eye.

2. The display device of claim 1 wherein said rigid flattened main body is made of extruded plastic.

3. The display device of claim 1 wherein said channels contained in said main body overlap and extend the full length of the main body.

4. The display device of claim 1 wherein said arm member supports comprise a rigid arm bar and holding pad located on the fore-end of said arm bar, and said arm member supports serve as slidable appendages capable of being either inserted into or removed from said main body.

5. The display device of claim 4 wherein said rigid arm bar is made of aluminum.

6. The display device of claim 4 wherein said rigid arm bar is of a thickness proportional to the channels contained in the main body and when the aft-end of said arm bar is inserted into said main body channels in a straight line motion it occupies a portion or the entire channel length contained in the main body and serves as the slidable means to expand and adjust to the dimensions of the textile to be displayed upon it.

7. The display device of claim 4 wherein said holding pad is comprised of extruded plastic of predetermined size proportionate in thickness to said main body and the face of the holding pad having fused onto it a holding strap containing hook fasteners proportionate in size to the holding pad, said holding strap serving as the coupling means to support and display nappy textured textiles.

8. The display device of claim 1 herein said arm member supports employ a plurality of support spacers.

9. The display device of claim 8 wherein said support spacers are made of extruded plastic.

10. The display device of claim 9 wherein said support spacers are of predetermined size proportionate to said holding pads and have a plurality of channels therein proportionate to and coinciding with the proportions of the channels contained within the main body, the channels within said support spacers allowing the support spacers to slide onto the aft-end of said slidable arm members, the face of said support spacers having fused onto it a holding strap containing hook fasteners which serve as the coupling means to provide additional support of nappy textured textiles whereby when the support spacers are slid onto said bar elements of the slidable arm members and the slidable arm members are slid towards or away from the main body, the support spacers can be slid anywhere along the exposed bar of the slidable arm member to provide added support if necessary for textiles for the expanse between the main body and holding pads.

* * * * *